US006433292B1

(12) United States Patent
Tate

(10) Patent No.: US 6,433,292 B1
(45) Date of Patent: Aug. 13, 2002

(54) INTERIOR TRUNK LID MOUNTED EMERGENCY TRUNK RELEASE

(76) Inventor: Rick W. Tate, 4978 S. 1130 West, Taylorsville, UT (US) 84123

( * ) Notice: Subject to any disclaimer, the term of this patent is extended or adjusted under 35 U.S.C. 154(b) by 0 days.

(21) Appl. No.: 09/408,576

(22) Filed: Sep. 29, 1999

Related U.S. Application Data

(60) Provisional application No. 60/108,519, filed on Nov. 16, 1998.

(51) Int. Cl.[7] ..... H01H 1/00
(52) U.S. Cl. ..... 200/512
(58) Field of Search ..... 200/86 R, 85 R, 200/85 A, 512

(56) References Cited

U.S. PATENT DOCUMENTS

| | | | | | |
|---|---|---|---|---|---|
| 3,566,703 | A | | 3/1971 | Van Noord | 74/50 |
| 3,936,086 | A | | 2/1976 | Berkowitz | 292/341 |
| 4,200,777 | A | * | 4/1980 | Miller | 200/85 A |
| 4,203,622 | A | | 5/1980 | Cook et al. | 292/221 |
| 4,331,353 | A | | 5/1982 | Yazawa et al. | 292/28 |
| 4,478,441 | A | | 10/1984 | Fiordellisi et al. | 292/216 |
| 4,667,990 | A | | 5/1987 | Quantz | 292/201 |
| 4,979,384 | A | | 12/1990 | Malesko et al. | 70/241 |
| 5,180,198 | A | | 1/1993 | Nakamura et al. | 292/201 |
| 5,445,326 | A | | 8/1995 | Ferro et al. | 292/336 |
| 5,626,039 | A | | 5/1997 | Solari et al. | 70/279 |
| 5,711,559 | A | | 1/1998 | Davis | 292/340 |
| 5,791,179 | A | | 8/1998 | Brask | 70/278 |
| 5,859,479 | A | * | 1/1999 | David | 307/10.8 |
| 6,018,292 | A | * | 1/2000 | Penny, Jr. | 340/426 |
| 6,130,614 | A | * | 10/2000 | Miller et al. | 240/573.4 |
| RE37,290 | E | * | 7/2001 | David | 307/10.8 |

OTHER PUBLICATIONS

Great Britain Pat. No. 2213194, Nagai et al., Aug. 1989.
Geat Britain Pat. No. 755206, Herbert et al., Aug. 1956.

* cited by examiner

*Primary Examiner*—Renee Luebke
(74) *Attorney, Agent, or Firm*—Richard C. Litman

(57) ABSTRACT

The invention is an electronic vehicle trunk lock switch, mounted on the inside lid of a vehicle trunk for emergency release of a trapped occupant. The switch is formed by two copper plates, separated by a foam spacer. The two copper plates come in contact with each other upon contact with the switch, completing a circuit between the battery and electric trunk lock. The switch is then designed to release the electric trunk lock.

4 Claims, 2 Drawing Sheets

INTERIOR TRUNK LID MOUNTED EMERGENCY TRUNK RELEASE

CROSS-REFERENCE TO RELATED APPLICATION

This application claims the benefit of U.S. Provisional Patent Application Ser. No. 60/108,519, filed Nov. 16, 1998.

BACKGROUND OF THE INVENTION

1. Field of the Invention

The present invention relates to a vehicle trunk lock switch mounted inside a vehicle trunk. More specifically, the invention is an oversized touch panel mounted to the interior of the trunk lid, positioned there to be readily struck when a trapped occupant flails or causes other unintentional contact. When the invention is struck, it completes an electrical circuit to release an electrical vehicle trunk lock, thereby opening the vehicle trunk.

2. Description of Related Art

Children becoming locked or trapped within confined spaces have always been a legitimate safety concern. Old refrigerator door and latch assemblies have been considered dangerous because children can easily accidentally lock themselves into an old refrigerator. To address this safety concern, the entire door might be removed to prevent children from locking themselves into the refrigerator.

Similarly, automotive vehicle trunks have also been considered dangerous since children can easily accidentally lock themselves into the trunk of a given vehicle. Earlier vehicles have addressed this concern by having mechanical safety devices that could be mechanically operated from within the trunk itself to release trapped children. A variety of such devices are outlined in U.S. Pat. No. 5,445,326 issued to Ferro et al. and U.S. Pat. No. 5,711,559 issued to Davis. These devices have been successful with earlier makes of automotive vehicles that do not utilize electronic trunk locks. However, later makes of vehicles commonly utilize electronic door and trunk locks. Therefore, an electronic device for vehicle trunks that can release a child internally trapped within the trunk with an electronic trunk lock would be a valuable device.

Moreover, the use of a mechanical trunk release often depends on a trapped occupant's cognizance of the existence of the release mechanism, and, the subsequent execution of rational actions by the trapped occupant. Children especially, often lack the general awareness or technical cognizance to effectively release themselves from the interior of a dark trunk. Moreover, even adults, brought to panic by the emergency situation, may be unable to free themselves. Thus, the present invention eliminates the need for either cognizance or intentional actions by the trapped occupant, providing a device that takes advantage of otherwise unintentional body movements caused by a trapped individual. Such movements are nevertheless naturally responsive to the cramped quarters and panic-response, which might include flailing of extremities, the bumping of one's head or other upper body parts, and similar actions.

None of the above inventions and patents, taken either singly or in combination, is seen to describe the instant invention as claimed.

SUMMARY OF THE INVENTION

Accordingly, the invention is an electronic vehicle trunk lock switch mounted on the inside lid of a vehicle trunk. The switch is formed by two copper plates separated by a resilient foam spacer. The two copper plates come in contact with each other upon striking the switch, completing a circuit between the battery and electric trunk lock. The switch is placed in the circuit of the preexisting electrical system of the vehicle to release the electric trunk lock and open the trunk.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
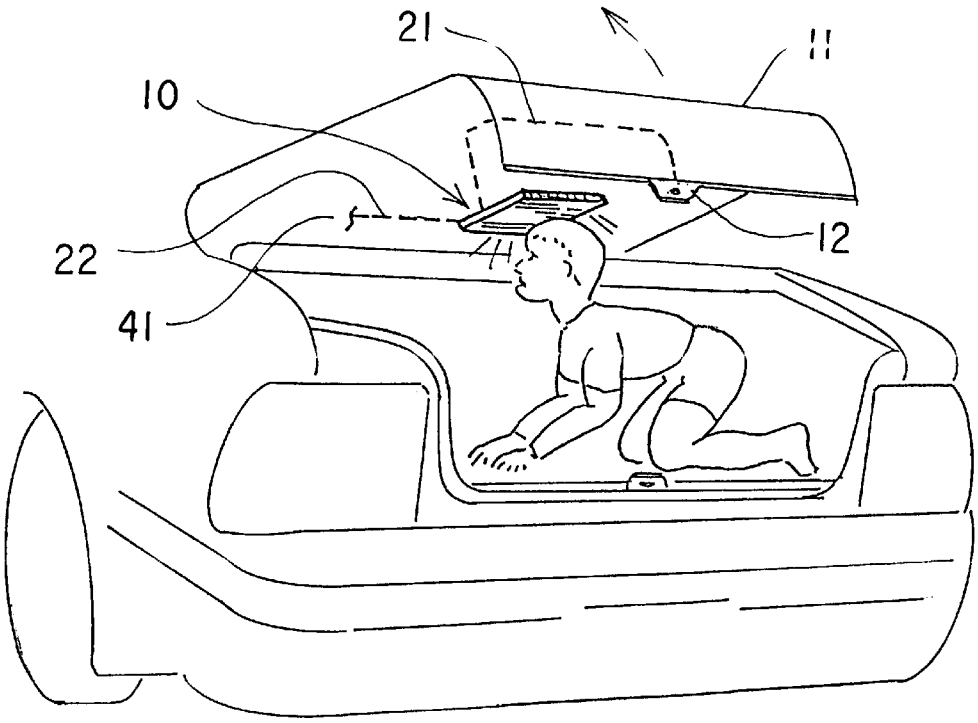
FIG. 1 is an environmental, perspective view of the electric trunk lock switch as installed in a vehicle trunk according to the present invention.

The present invention is an electronic vehicle trunk lock switch 10 that can be mounted on the inside lid of a trunk to facilitate escape by a trapped occupant. As suggested by FIG. 1, a child, having been locked inside of a vehicle trunk, hits the vehicle trunk lock switch 10 with his head by an inadvertent movement. The lid of the trunk 11 is shown subsequently opened when the electric trunk door locking device 12, which is electrically connected to the vehicle trunk lock switch 10 by lock lead 21, is released by the completed circuit caused by contact with the vehicle trunk lock switch 10. As can be understood from both FIG. 1 and FIG. 4, a battery lead 22 comes from vehicle battery 41 and leads to the vehicle trunk lock switch 10 to form a normally open circuit in parallel with the preexisting electrical lock circuit.

Figure 2:
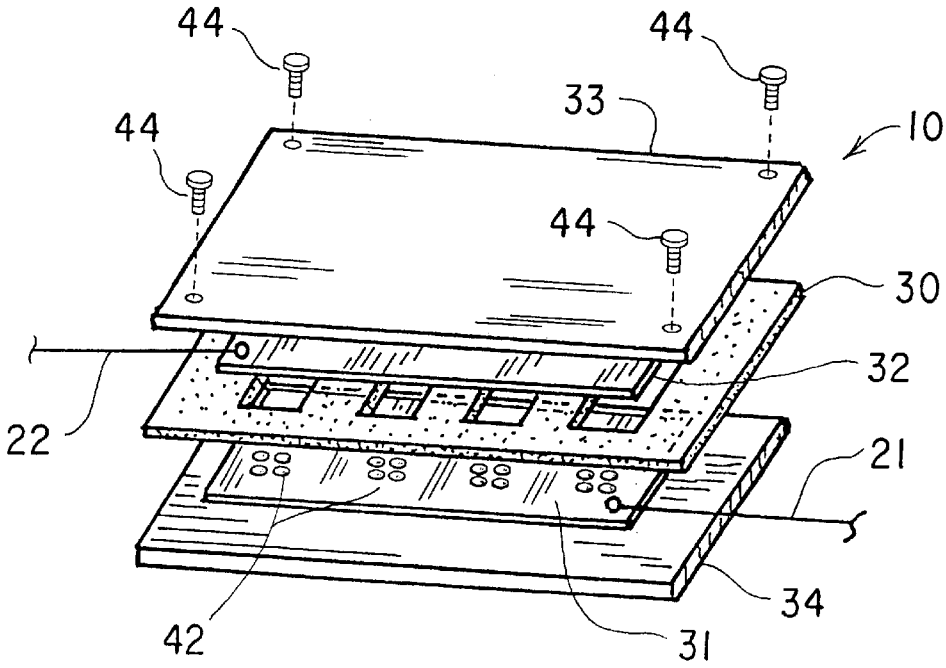
FIG. 2 is an exploded perspective view of the electric trunk lock switch.

Specific structural features of the vehicle trunk lock switch 10 adapt it for use in accordance with its purpose as suggested above. The main features of the vehicle trunk lock switch 10 include a pair of mechanically deformable or flexible electronically conductive panels spaced apart by a resilient foam spacer 30. In the preferred embodiment according to FIG. 2, the panels are an upper and lower copper plate 32, 31. It is noted that another metal, such as steel, aluminum, silver, or gold, can be used. Thus, upon impact of the child's head against the vehicle trunk lock switch 10 as shown in FIG. 1, the lower copper plate 31 is compressed into the resilient foam spacer 30. The lower copper plate 31 is blistered 42 to enhance contact between the lower copper plate 31 and upper copper plate 32. The resilient foam spacer 30 is a soft and thin sheet of neoprene, which has several hollowed out slots which enables the flexible lower copper plate 31 to be pressed through the slots on the resilient foam spacer 30. Contact is made between the copper plates 31 and 32, completing an electrical circuit between the battery 41, battery contact 22, vehicle trunk lock switch 10, the vehicle trunk lock lead 21 and the electric trunk door locking device 12.

Figure 3:
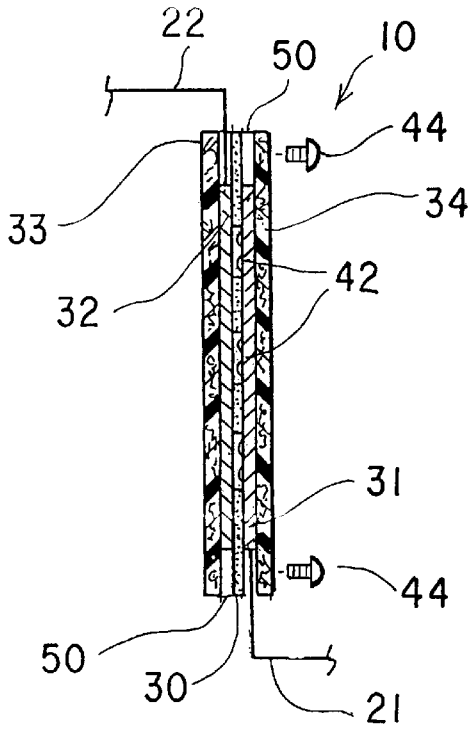
FIG. 3 is a cross sectional view of the electric trunk lock switch.

A cross sectional view of the vehicle trunk lock switch 10 is provided in FIG. 3. Pieces of insulation 33 and 34 surround and are glued or laminated with an adhesive layer 50 over the copper plates 31 and 32, to electrically insulate and otherwise protect them from contact with other outside materials in the trunk. The insulation pieces 33, 34 may be flexible vinyl or plastic sheets.

To mount the vehicle trunk lock switch 10, plastic screw nails 44 serve as a fastening means. The plastic screw nails 44 are part of the installation of the vehicle trunk lock switch 10.

Figure 4:
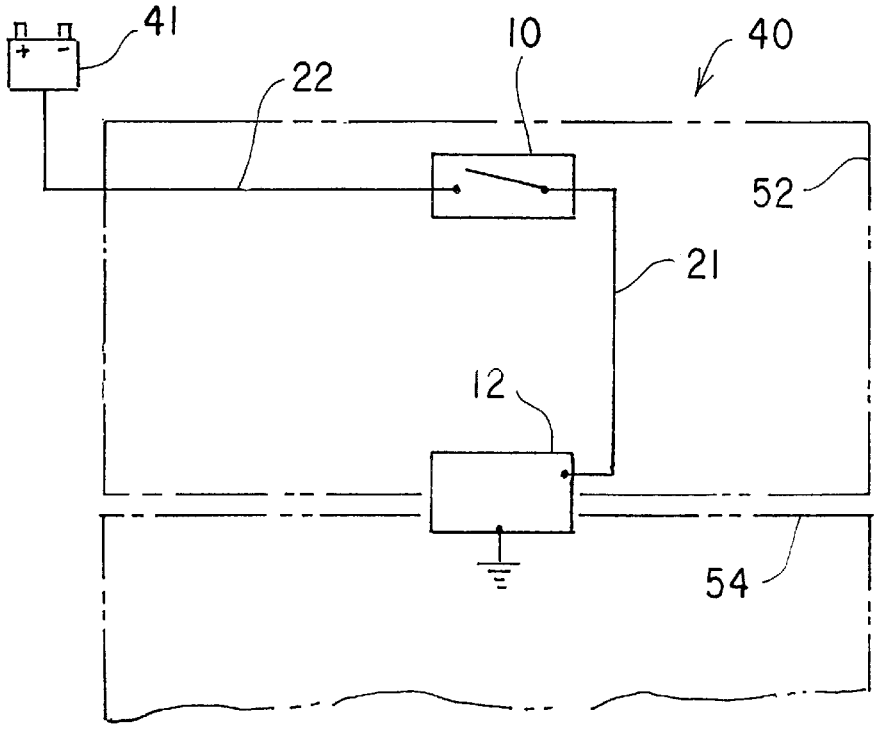
FIG. 4 is a schematic diagram of the electric trunk lock switch as wired in a vehicle's electrical system.

As shown in the wiring diagram provided in FIG. 4, the vehicle trunk lock switch 10 is provided with a battery lead 22 and a lock lead 21. The battery lead 22 is operably connected to the battery 41 of the vehicle and the lock lead 21 is operably connected to the vehicle trunk lock switch 10. The phantom boxes 52, 54 respectively represent the trunk lid 52 and the trunk cavity body 54. The vehicle trunk lock switch 10 is installed on a vehicle that has an electric trunk door lock 12, and, of course cannot be installed on a vehicle that does not have an electric release for a trunk door lock 12. However, by tapping into its electrical system, a vehicle using a mechanical trunk lock may nevertheless be retrofitted with an electrical lock for use with the present invention. A typical electrical trunk lock 12, as factory installed, might comprise the mechanically mating lid latch and latch release mechanism, which would be electrically activated by an internal electrical switch, which is both key and driver operated. The present invention would be similarly wired in parallel, with the internal electrical switch circuited directly to the trunk release in a manner to override the other preexisting electrical switches.

It is to be understood that the present invention is not limited to the sole embodiments described above, but encompasses any and all embodiments within the scope of the following claims.

I claim:

1. A motor vehicle comprising:

an electrical system including a battery;

a trunk having a trunk lid having an interior side;

an electrically operated trunk lock comprising a lid latch and an electrically activated latch release mechanism; and a switch mounted to said interior side of said trunk lid, said switch comprising:

a pair of flexible electrically conductive plates spaced apart a predetermined distance permitting contact of said plates when flexed by a compressive force;

a resilient foam spacer disposed between each of the said pair of plates;

a lock lead attached to one said plate;

a battery lead attached to the other plate; and insulating material electrically insulating said pair of plates from external contact;

wherein said lock lead is electrically connected to said latch release mechanism, and said battery lead is operably connected to said battery.

2. The vehicle trunk according to claim 1, wherein said foam spacer is one of glued or laminated between said plates and said insulating material surrounds and is one of glued or laminated around said plates.

3. The vehicle trunk according to claim 1, wherein said foam spacer has open slots for enabling the two plates to come in contact when they are compressed.

4. The vehicle trunk according to claim 1, wherein said plates include a metal selected from the group consisting of copper, steel, aluminum, silver and gold.

* * * * *